US007063388B2

(12) United States Patent
Chen

(10) Patent No.: US 7,063,388 B2
(45) Date of Patent: Jun. 20, 2006

(54) SPRING CHAIR (CUSHION) STRUCTURE

(76) Inventor: Chih-Yung Chen, No.1-1, Chu Lu Lane, Zhong Zhuang Village, Hua Tan Hsiang, Changhua Hsien (TW)

( * ) Notice: Subject to any disclaimer, the term of this patent is extended or adjusted under 35 U.S.C. 154(b) by 0 days.

(21) Appl. No.: 10/891,036

(22) Filed: Jul. 15, 2004

(65) Prior Publication Data

US 2006/0012235 A1 Jan. 19, 2006

(51) Int. Cl.
*A47C 7/14* (2006.01)

(52) U.S. Cl. ..... 297/451.7; 297/452.54; 297/452.52; 267/154

(58) Field of Classification Search ..... 297/461, 297/452.48, 452.49, 452.52, 452.54, 451.7; 267/166, 182, 154 X; 5/653, 654.1, 655.7, 5/247, 255

See application file for complete search history.

(56) References Cited

U.S. PATENT DOCUMENTS 2,836,912 A * 6/1958 Ranucci ..... 40/470
2,855,984 A * 10/1958 Majorana et al. ..... 297/378.1
4,856,765 A * 8/1989 Kohno et al. ..... 267/166
5,632,473 A * 5/1997 Dias Magalhaes Queiroz .. 267/164
6,079,782 A * 6/2000 Berg et al. ..... 297/284.3
6,128,798 A * 10/2000 Barman et al. ..... 5/716

* cited by examiner

*Primary Examiner*—Anthony D. Barfield
(74) *Attorney, Agent, or Firm*—Rabin & Berdo, P.C.

(57) ABSTRACT

A spring chair (cushion) structure in which the spring chair (cushion) structure, elastic body, flexile rods have sufficient pliancy and, furthermore, are slanted at equal intervals apart such that they conjoin two frame members into a single structural entity. When sitting in the spring chair (cushion) structure, body weight is utilized to directly cause the torsional resiliency of the elastic body to produce an appropriate spring-loaded and buffered effect.

5 Claims, 8 Drawing Sheets

SPRING CHAIR (CUSHION) STRUCTURE

BACKGROUND OF THE INVENTION

1) Field of the Invention

The invention herein relates to a spring chair (cushion) structure in which the spring chair (cushion) structure elastic body has torsional resiliency. When the user sits on the spring chair (cushion) structure, body weight directly causes the torsional resiliency of the elastic body to produce an appropriate spring-loaded and buffered effect such that the user feels comfortable while sitting on the spring chair (cushion).

2) Description of the Prior Art

In currently observed chairs having spring seat cushions, the seat cushion sections typically consist of several compressed springs or sponge plies. If the seat cushion has a several compressed springs, the compressed springs easily develop elastic fatigue after a prolonged period and extended chair usage or if it has several sponge plies, the long-term application of heavy weight results in unrecoverable resilience. Therefore, when the user sits in such chairs for a lengthy period of time, the seat cushion is not firm and lower back discomfort readily occurs.

In view of the said shortcomings, the applicant of the invention herein conceived of a thoughtful and original idea based on many years of design experience and extensive investigation that, following repeated sample testing and numerous refinements, culminated in the introduction of the invention herein.

SUMMARY OF THE INVENTION

The primary objective of the invention herein is to provide a spring chair (cushion) structure in which the spring chair (cushion) structure, elastic body, flexile rods have sufficient pliability and, furthermore, are slanted at equal intervals apart such that they conjoin two frame members into a single structural entity. When sitting in the spring chair (cushion) structure, body weight is utilized to directly cause the torsional resiliency of the elastic body to produce an appropriate spring-loaded and buffered effect such that the user feels comfortable while sitting on the spring chair (cushion).

DETAILED DESCRIPTION OF THE INVENTION

The brief description of the drawings are accompanied below by the detailed description of the present invention.

Figure 1:
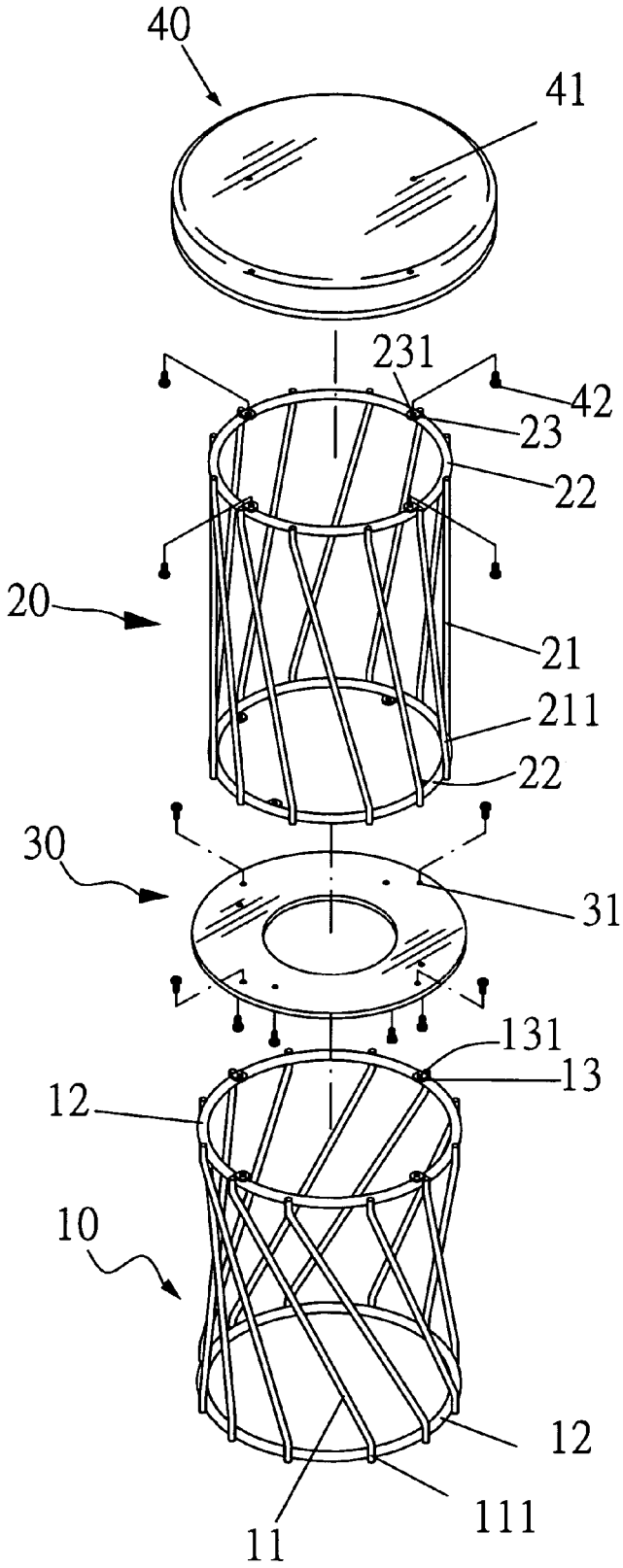
FIG. 1 is an exploded drawing of the invention herein.
Figure 2:
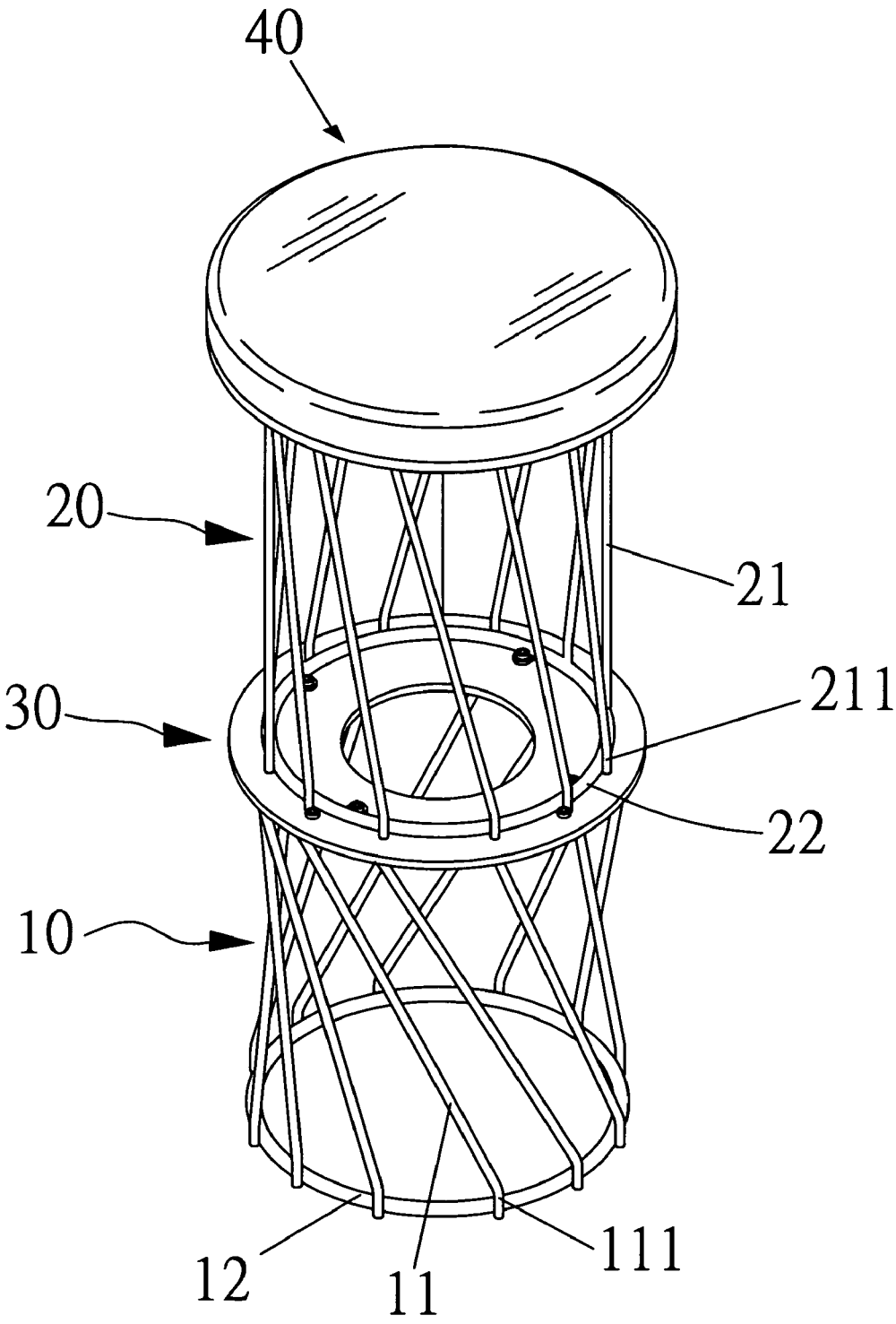
FIG. 2 is an isometric drawing of the invention herein.

Referring to FIG. 1 and FIG. 2, the spring chair (cushion) of the invention herein is comprised of an elastic body 10, another elastic body 20, a junction plate 30, a plurality of screws 32, and a seat 40; since the elastic body 10 flexile rods 11 have sufficient pliancy and, furthermore, are slanted at equal intervals apart such that the end sections 111 and two frame member 12 circumferences are conjoined into a single structural entity, a balanced torsional resiliency potential results and, additionally, lock pieces 13 project from threaded holes 131 along the circumference at one end of a frame member 12; since the elastic body 20 flexile rods 21 have sufficient pliancy and, furthermore, are slanted at equal intervals apart such that the end sections 211 and two frame member 22 circumferences are conjoined into a single structural entity, a balanced torsional resiliency potential results, and locking pieces 23 project from threaded holes 231 along the circumferences of the two frame members 22; the junction plate 30 has a plurality of threaded holes 31; and the seat 40 consists of a mounting plate 41 having a plurality of threaded holes 42; when assembled, the junction plate 30 is placed onto the elastic body 10 and the screws 32 are fastened into the junction plate 30 threaded holes 31 as well as the frame member 12 lock piece 13 threaded holes 131, following which the elastic body 20 is placed onto the junction plate 30 and the screws 32 are fastened into the frame member 22 lock piece 23 threaded holes 231 as well as the junction plate 30 threaded holes 31, and finally the seat 40 mounting plate 41 is placed onto the elastic body 20, and the screws 32 are fastened into the seat 40 mounting plate 41 threaded holes 42 as well as the frame member 22 lock piece 23 threaded holes 231, which thereby completes the assembly of the spring chair (cushion); when the user sits on the spring chair (cushion), body weight directly causes the torsional resiliency of the elastic body 10 and the other elastic body 20 to produce a spring-loaded and buffered effect such that the user feels comfortable while sitting in the spring chair (cushion).

Figure 4:
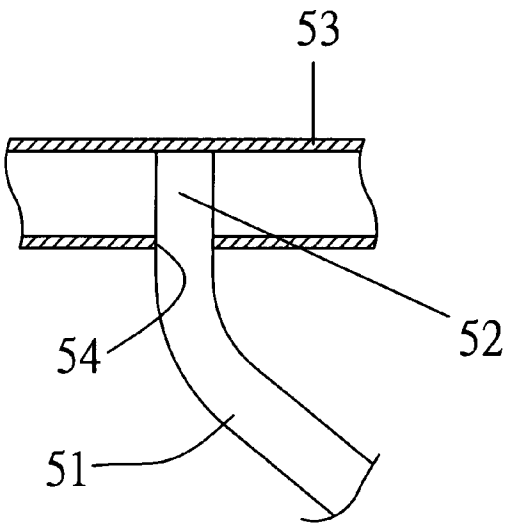
FIG. 4 is a partial cross-sectional drawing of the other elastic body embodiment of the invention herein.
Figure 3:
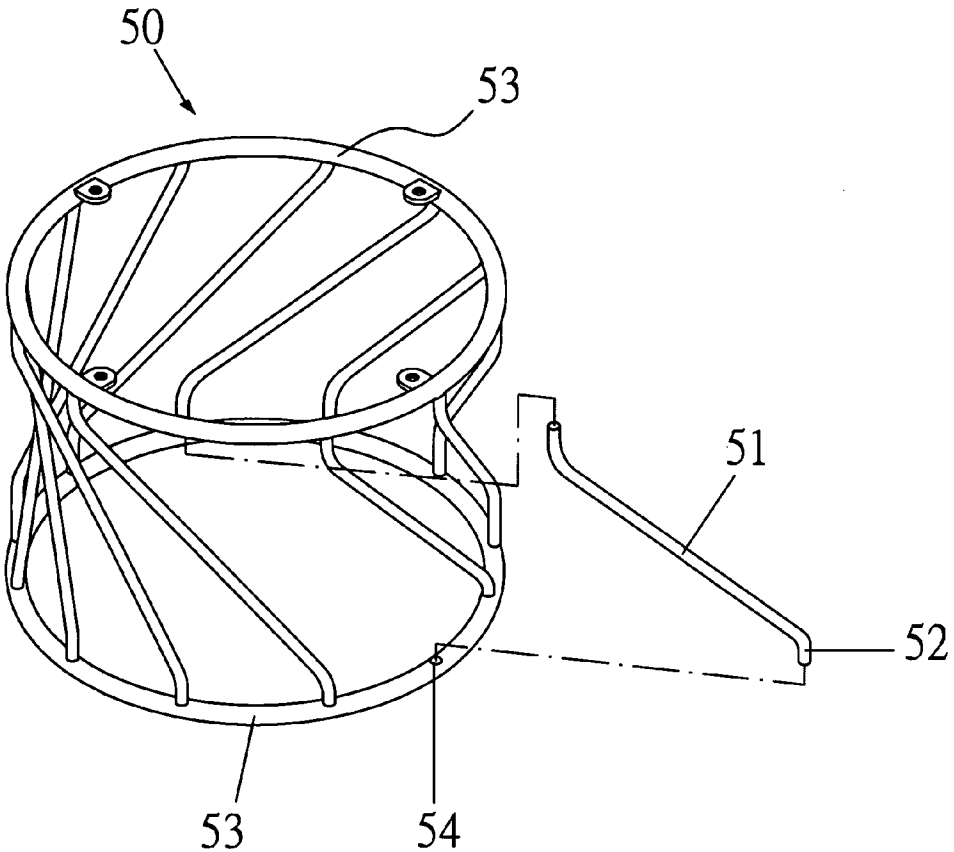
FIG. 3 is an exploded drawing of another elastic body embodiment of the invention herein.

Referring to FIG. 3 and FIG. 4, the spring chair (cushion) elastic body 50 can consist of a plurality of sufficiently pliant flexile rods 51 angularly arrayed at equal intervals apart, the end sections 52 of which are inserted into the round holes 54 along the circumference of two tubular frame members 53 to thereby conjoin them into a single structural entity and, as a result, the elastic body 50 is capable of producing a balanced torsional resiliency.

Figure 5:
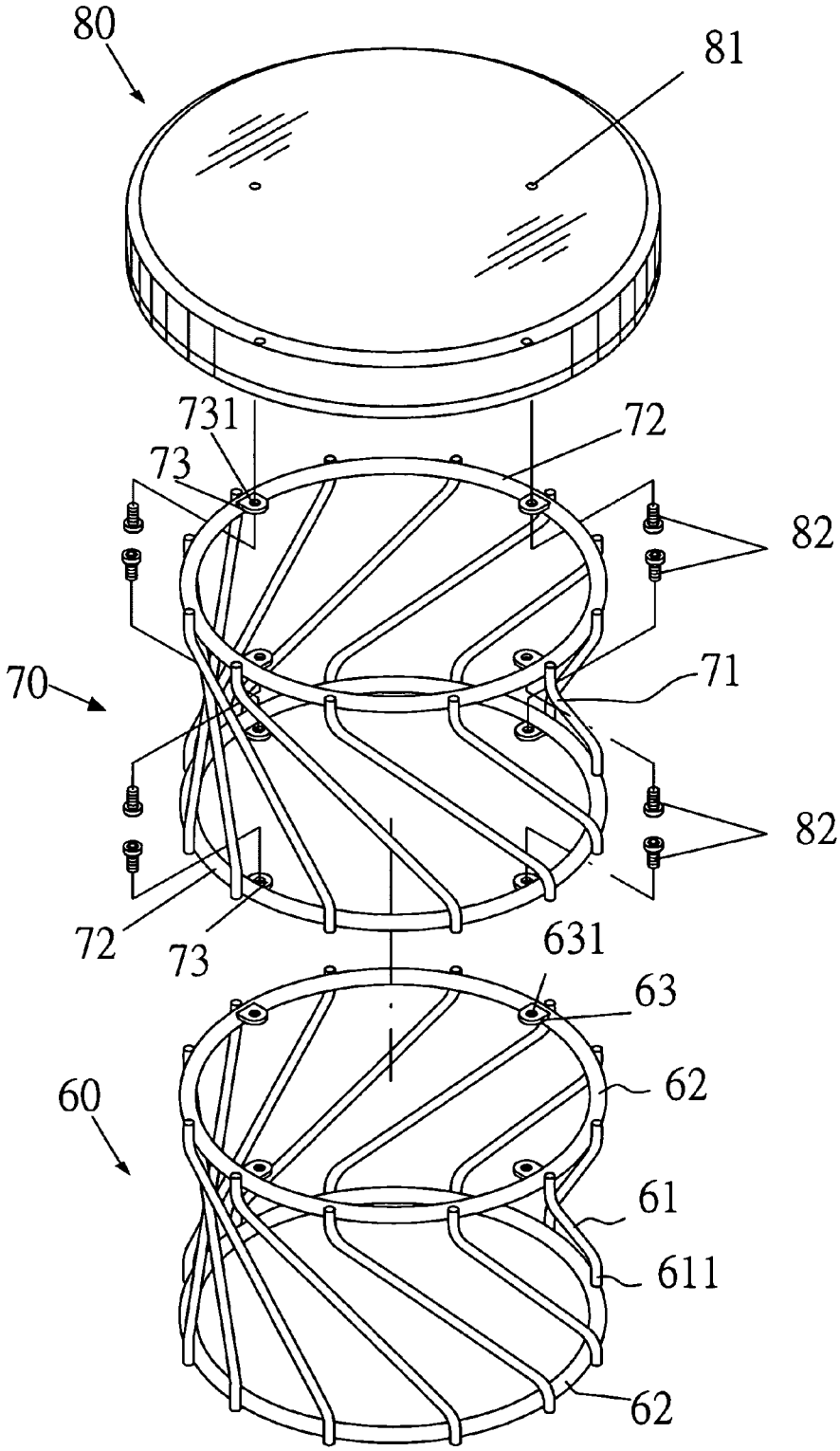
FIG. 5 is an exploded drawing of another embodiment of the invention herein.
Figure 6:
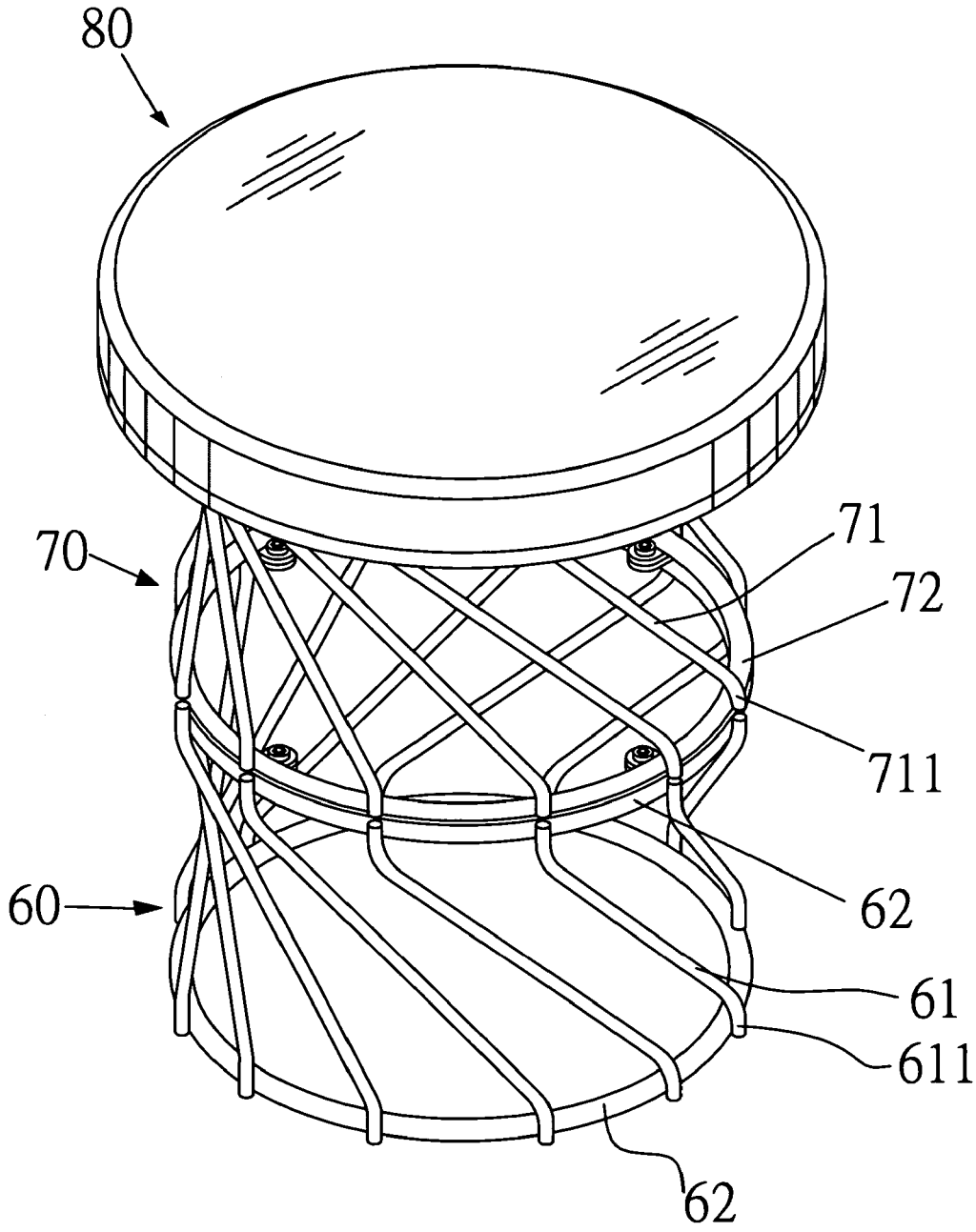
FIG. 6 is an isometric drawing of another embodiment of the invention herein.
Figure 7:
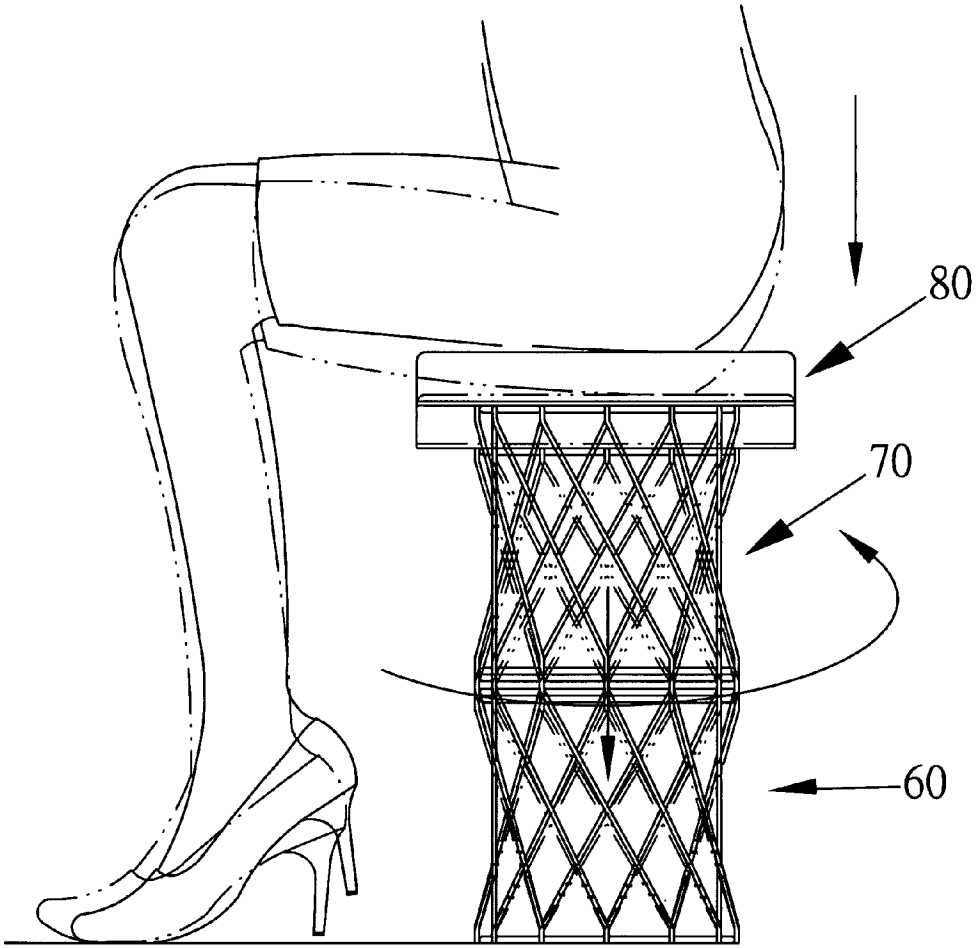
FIG. 7 is an orthographic drawing of the other embodiment of the invention that illustrates utilization.

Referring to FIG. 5. FIG. 6, and FIG. 7, another spring chair (cushion) embodiment of the invention herein is comprised of an elastic body 60, another elastic body 70, a seat 80, and a plurality of screws 82; since the elastic body 60 flexile rods 61 have sufficient pliancy and, furthermore, are slanted at equal intervals apart such that the end sections 611 and two frame member 62 circumferences are conjoined into a single structural entity, a balanced torsional resiliency potential results and, additionally, lock pieces 63 project from threaded holes 631 along the circumference at one end of a frame member 62; since the elastic body 70 flexile rods 71 have sufficient pliancy and, furthermore, are slanted at equal intervals apart such that the end sections 711 and two flame member 72 circumferences are conjoined into a single structural entity, a balanced torsional resiliency potential results, and locking pieces 73 project from threaded holes 731 along the circumferences of the two frame members 22;

and the seat 80 has a plurality of threaded holes 81 on its bottom surface; when assembled, the elastic body 60 and the other elastic body 70 are vertically stacked, the screws 82 are fastened into the frame member 82 lock piece 63 threaded holes 631 as well as the frame member 72 lock piece 73 threaded holes 731, following which the seat 80 is placed onto the elastic body 70, and the screws 82 are fastened into the frame member 72 lock piece 73 threaded holes 731 as well as the seat 80 threaded holes 81, which thereby completes the assembly of the spring chair (cushion); when the user sits on the spring chair (cushion), body weight directly causes the torsional resiliency of the elastic body 60 and the elastic body 70 to produce a spring-loaded and buffered effect such that the user feels comfortable while sitting in the spring chair (cushion).

Figure 8:
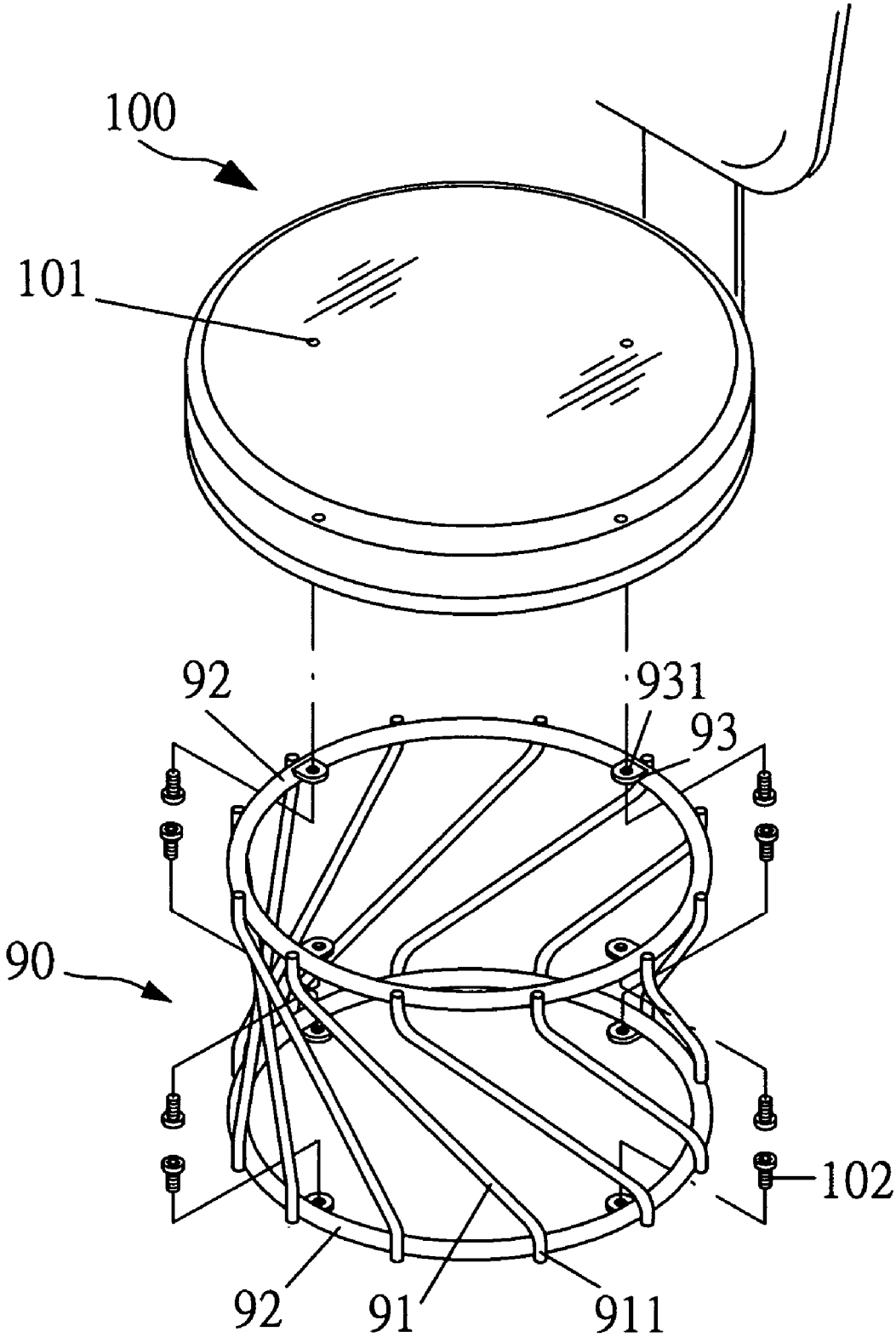
FIG. 8 is an exploded drawing of yet another embodiment of the invention herein.
Figure 9:
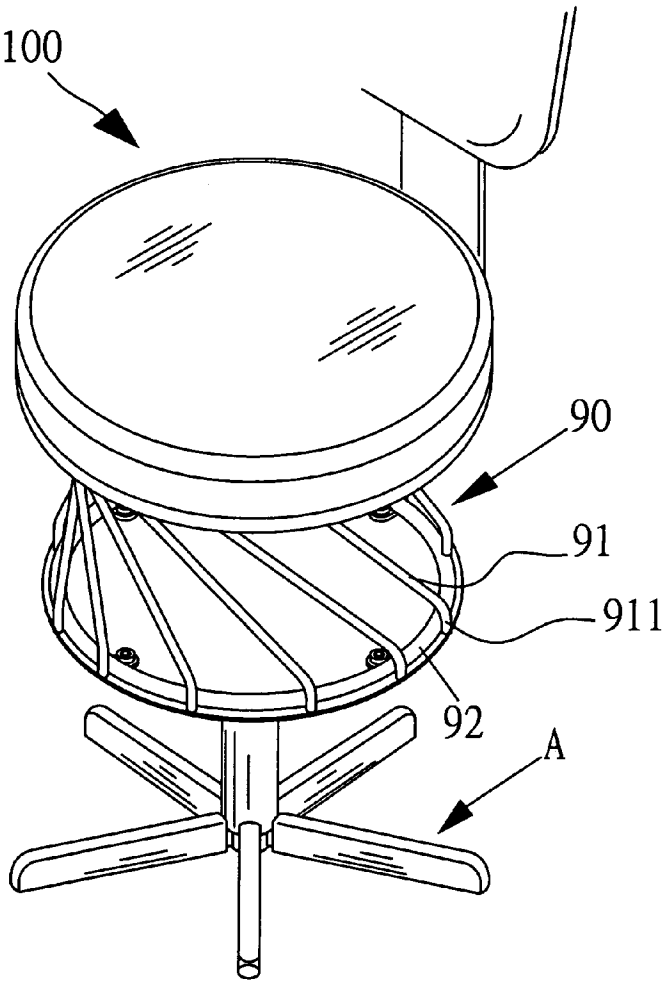
FIG. 9 is an isometric drawing of still another embodiment of the invention herein.

Referring to FIG. 8 and FIG. 9, yet another spring chair (cushion) embodiment of the invention herein is comprised of an elastic body 90, a seat 100, and a plurality of screws 102; since the elastic body 90 flexile rods 91 have sufficient pliancy and, furthermore, are slanted at equal intervals apart such that the end sections 911 and two frame member 92 circumferences are conjoined into a single structural entity, a balanced torsional resiliency potential results, and locking pieces 93 project from threaded holes 931 along the circumferences of the two frame members 92; and the seat 100 has a plurality of threaded holes 101 on its bottom surface; when assembled, the elastic body 90 and the chair legs A are vertically stacked, the screws 82 are fastened into the frame member 92 lock piece 93 threaded holes 931 and the chair legs A, following which the seat 100 is placed on the elastic body 90, and the screws 102 are fastened into the frame member 92 lock piece 93 threaded holes 931 as well as the seat 100 threaded holes 101, which thereby completes the assembly of the spring chair (cushion); when the user sits on the spring chair (cushion), body weight directly causes the torsional resiliency of the elastic body 90 to produce a spring-loaded and buffered effect such that the user feels comfortable while sitting in the spring chair (cushion).

In summation of the foregoing section, since the invention herein is already of an advanced innovative structure that possesses improved original content, while also capable of achieving industrial utility and progressiveness, and thus meets patent law regulations, the present invention is lawfully submitted for patent application to the patent bureau for review and the granting of the commensurate patent rights.

However, the said description only elaborates the most preferred embodiments of the invention herein and shall not be construed as limitation of the scope of the present invention; all modification and embellishments based on the patent application claims of invention herein shall remain proprietary to and protected under the claims of present invention.

The invention claimed is:

1. A spring chair structure, comprising:

an elastic body having two spaced-apart hoop-shaped frame members, and at least twelve flexile rods angularly-arranged and spaced from each other at equal intervals, with a first end of each flexile rod being attached to one of said frame members, and with a second end of each flexile rod being attached to another one of said frame members, each flexile rod being essentially straight over a maiority of its length, the elastic body being adapted to produce a balanced torsional resiliency; and a seat attached to said one of said frame members.

2. The spring chair structure recited in claim 1, wherein said flexile rods are pliant.

3. The spring chair structure recited in claim 1, wherein said elastic body has an end sections that can be conjoined to an end section of another elastic body into a single structural entity, at the outer side, the inner side, or face to face of their said two frame members.

4. The spring chair structure recited in claim 1, wherein said frame members are formed from rods.

5. The spring chair structure recited in claim 1, wherein said frame members have lock pieces projecting from threaded holes along their circumferences that provide for fastening.

* * * * *